US006863096B2

(12) United States Patent
Amano

(10) Patent No.: US 6,863,096 B2
(45) **Date of Patent: *Mar. 8, 2005**

(54) METHOD OF PACKING A CONTAINER WITH POWDER AND APPARATUS FOR THE SAME

(75) Inventor: Hirosato Amano, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/631,688

(22) Filed: Jul. 31, 2003

(65) Prior Publication Data

US 2004/0020553 A1 Feb. 5, 2004

Related U.S. Application Data

(63) Continuation of application No. 09/572,364, filed on May 17, 2000, now Pat. No. 6,648,029.

(30) Foreign Application Priority Data

May 17, 1999 (JP) ..... 11-135517
May 8, 2000 (JP) ..... 2000-134361

(51) Int. Cl.[7] ..... B65B 31/00
(52) U.S. Cl. ..... 141/59; 141/69
(58) Field of Search ..... 141/59, 69, 71–74, 141/80

(56) References Cited

U.S. PATENT DOCUMENTS

| | | | |
|---|---|---|---|
| 773,877 | A | 11/1904 | Lorillard |
| 2,331,540 | A | 10/1943 | Dilling |
| 4,151,087 | A | 4/1979 | Sakaguchi |
| 4,162,148 | A | 7/1979 | Furstenberg |
| 4,825,913 | A | 5/1989 | Stott |
| 5,562,758 | A | 10/1996 | Awaji |
| 5,711,353 | A | 1/1998 | Ichikawa et al. |
| 5,727,607 | A | 3/1998 | Ichikawa et al. |
| 6,065,509 | A | 5/2000 | Bonney et al. |

FOREIGN PATENT DOCUMENTS

| | | |
|---|---|---|
| GB | 726054 | 3/1955 |
| JP | 7125702 | 5/1995 |
| JP | 8100622 | 4/1996 |
| JP | 8198203 | 8/1996 |

*Primary Examiner*—Khoa D. Huynh
(74) *Attorney, Agent, or Firm*—Cooper & Dunham LLP

(57) ABSTRACT

An apparatus for packing a container with powder of the present invention includes a suction pipe. The suction pipe includes an air separating portion implemented by a plurality of layers that are sieve nets or filters each having a particular mesh size. The air separating portion can therefore suck air contained in the powder over its entire periphery, enhancing dense, accurate packing of the container with the powder.

12 Claims, 7 Drawing Sheets

METHOD OF PACKING A CONTAINER WITH POWDER AND APPARATUS FOR THE SAME

This is a Rule 1.53(b) continuation and claims the benefit of priority, of application Ser. No. 09/572,364 filed May 17, 2000 now U.S. Pat. No. 6,448,029.

BACKGROUND OF THE INVENTION

The present invention relates to a method of packing a container with a desired kind of powder and an apparatus for the same. The present invention is applicable not only to toner used in a copier, printer or similar electrophotographic image forming apparatus, but also to other various kinds of powder including pharmaceuticals, cosmetics, and foods.

A copier, for example, belonging to a family of electrophotographic image forming apparatuses includes a developing unit for developing a latent image formed on a photoconductive element with toner. A toner container packed with fresh toner is mounted to the developing unit for replenishing the toner to the developing unit. The prerequisite with the toner container is that it be densely and uniformly packed with the toner. While toner packing methods are disclosed in, e.g., Japanese Patent Laid-Open Publication Nos. 8-198203 and 7-125702, they have some problems left unsolved, as will be described specifically later.

SUMMARY OF THE INVENTION

It is therefore an object of the present invention to provide a powder packing method capable of packing a container with powder densely and uniformly in a short period of time and enhancing accurate packing, and an apparatus for the same.

In accordance with the present invention, a method of packing a container including a powder inlet and an air outlet with powder includes the steps of connecting the powder outlet of a hopper capable of storing the powder to the powder inlet, attaching a suction pipe to the air outlet, and then introducing the powder stored in the hopper into the container, and discharging air existing between the particles of the powder introduced into the container via the suction pipe to which vacuum is fed. The end portion of the suction pipe to be positioned at least in the container after the attachment to th container and constituting an air separating portion is implemented by a laminate of at least two filters each having a particular mesh size.

Also, in accordance with the present invention, an apparatus for packing a container including a powder inlet and an air outlet with powder includes a hopper connectable to the powder inlet and capable of storing the powder, and a suction pipe attachable to the air outlet. The end portion of the suction pipe to be positioned at least in the container after the attachment to the container and constituting an air separating portion is implemented by a laminate of at least two filters each having a particular mesh size.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
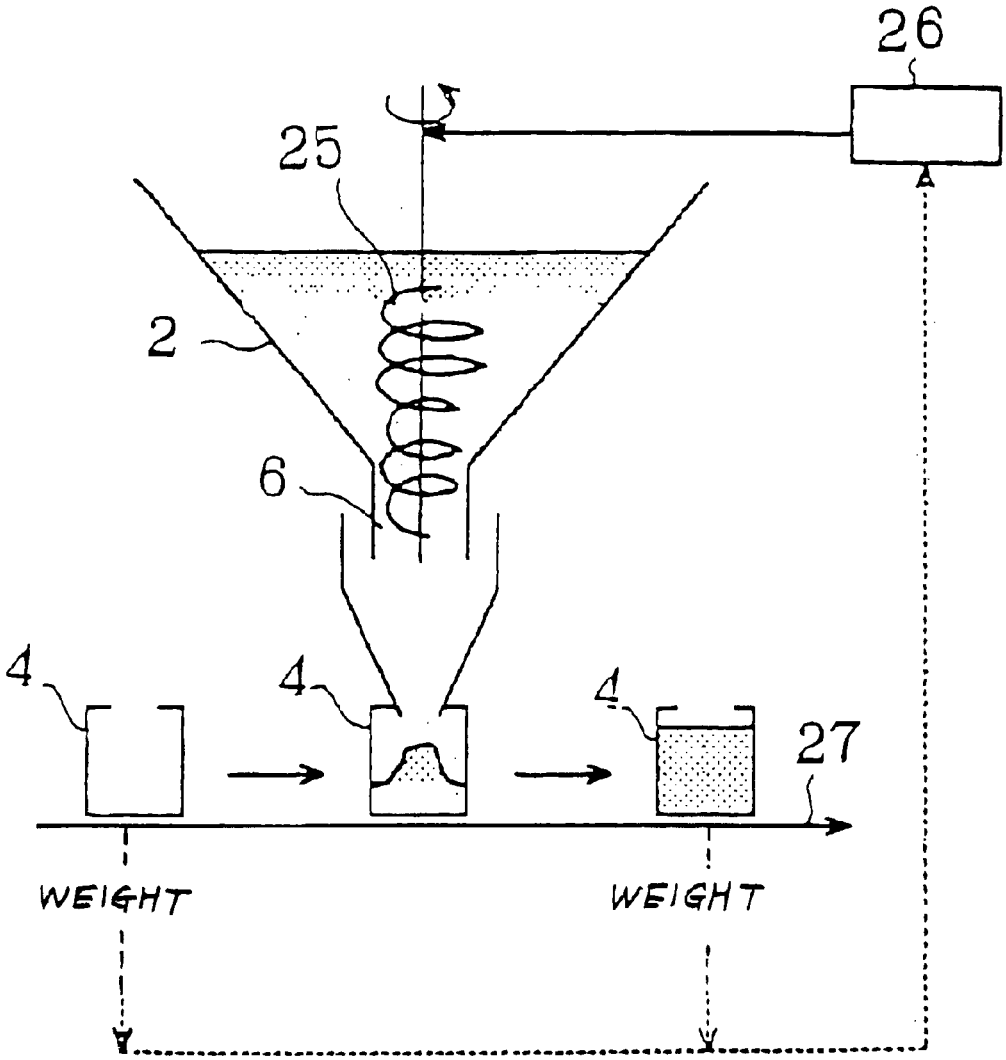
FIG. 1 PRIOR ART
FIG. 1 is a view showing a conventional apparatus for packing a container with toner.

To better understand the present invention, brief reference will be made to a conventional arrangement for packing a toner container with toner, shown in FIG. 1. As shown, a hopper 2 has an auger 25 arranged there inside. Toner is conveyed from, e.g., a large hopper, not shown, to the hopper 2 by a stream of air or similar conveying means and temporarily stored in the hopper 2. A conveyor 27 conveys a container 4 to be packed with the toner. When a drive motor 26 causes the auger 25 to rotate, the toner is introduced into the container 4 via the bottom opening of the hopper 2 and a metering portion 6 that meters the toner. As a result, the container 4 is packed with a preselected amount of toner.

More specifically, the container 4 being conveyed by the conveyor 27 has its tare measured before the packing of the toner. The number of rotations of the auger 25 is control led in terms of the number of rotations of the drive motor 26 in matching relation to the measured tare. After the container 4 has been packed with the toner, its weight is again measured in order to determine the amount of toner existing in the container 4 on the basis of a difference between the tare and the weight. If the amount of toner packed in the container 4 does not lie in an allowable range, i.e., it is short or excessive, the container 4 is discarded.

The amount of toner measured and introduced into the container 4 varies with the variation of the ratio of air existing between the particles of the toner. Generally, because the toner is conveyed to the hopper 2 by, e.g., a stream of air, it contains much air. This brings about a problem that a long period of times is necessary for the toner to sink in the container 4, resulting in inefficient packing. Another problem is that it is difficult to densely pack the container 4 with the toner.

In light of the above, Japanese Patent Laid-Open Publication Nos. 8-198203 and 7-125702 mentioned earlier propose to positively separate and discharge air, instead of causing the toner to naturally sink in the container 4, thereby implementing dense packing.

Figure 2:
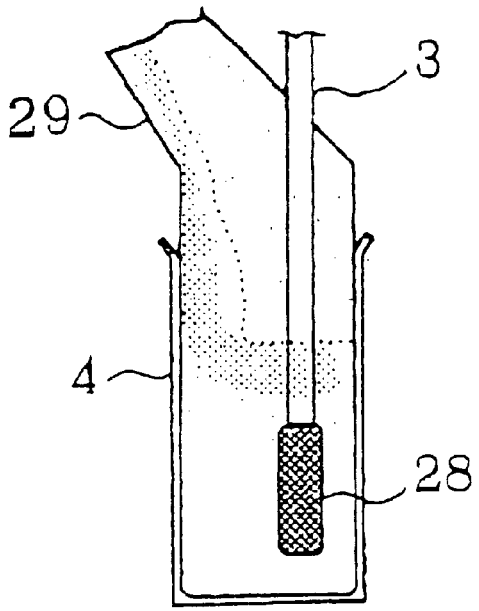
FIG. 2 PRIOR ART
FIG. 2 is a section showing another conventional apparatus for packing a container with toner.

Specifically, FIG. 2 shows a powder packing apparatus taught in the above Laid-Open Publication No. 8-198203. As shown, the apparatus includes a nozzle 29 with a suction pipe 3 affixed thereto. The suction pipe 3 has at its one end an air separating portion 28 formed with a number of apertures that pass air therethrough, but do not pass powder. The other end of the suction pipe 3 is communicated to a vacuum pump or similar vacuum source not shown. After the nozzle 29 has been set in the container 4, powder is introduced into th container 4 via the nozzle 29. At the same time, the vacuum source is driven to suck air existing between the particles of the powder via the suction pipe 3, thereby discharging such air. As a result, the container 4 is densely and uniformly packed with the powder.

The above-described apparatus has a problem that the air separating portion 28 must be formed with a number of apertures that pass air, but do not pass the powder, i.e., the suction pipe 3 having a small diameter must be formed with such apertures. This is difficult to practice and needs much time and cost. Further, air cannot be sufficiently separated from the powder at positions remote from the apertures, depending on the arrangement of the apertures. As a result, the distribution of air existing in the powder in the container 4 varies from one position to another position. Consequently, it is difficult to density and uniformly pack the container 4 with the powder.

Figure 3:
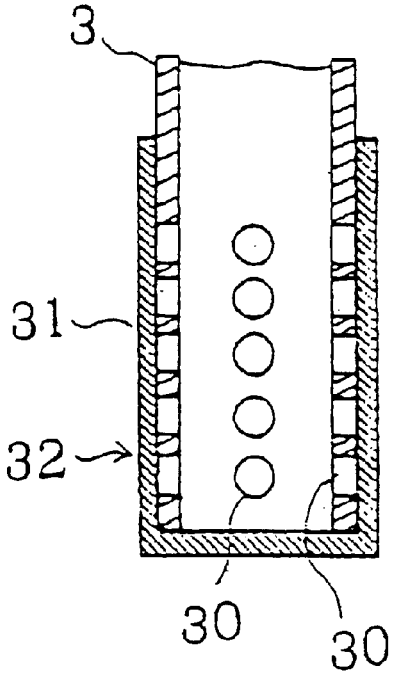
FIG. 3 PRIOR ART
FIG. 3 is a section showing still another conventional apparatus for packing a container with toner.

FIG. 3 shows a powder packing apparatus disclosed in Laid-Open Publication No. 7-125702 mentioned earlier. As shown, the apparatus includes an air separating portion 32 made up of a suction pipe 3 and a sieve net 31 wrapped around the suction pipe 3. The suction pipe 3 has a diameter of about 8 mm. A number of apertures 30 each having a diameter of 3 mm are formed in the end portion of the suction pipe 3, as illustrated. The sieve net 31 covers such an end portion of the suction pipe 3 and has a mesh size of about 2,000 to 3,000 smaller than the particle size of powder. With this configuration, the air separating portion 32 separates air from powder.

However, the sieve net with a small mesh size or a porous filter does not have sufficient mechanical strength or durability as to the separation of air from powder. This, coupled with the clogging of the net or the filter, results in frequent replacement and makes maintenance difficult. In addition, air is sucked only around the apertures 30 of the suction pipe 3 and obstructs the dense, uniform packing of a container with powder.

The present invention capable of solving the above problems will be briefly described first. In accordance with the present invention, a powder packing apparatus includes a hopper capable of storing powder and connectable to a powder inlet formed in a container. A suction pipe is attachable to an air outlet also formed in the container. The end portion of the suction pipe to be positioned at least in the container after the attachment to the container and constituting an air separating portion is implemented by a laminate of at least two filters each having a particular mesh size. It is to be noted that a filter refers to both of a filter and a sieve net.

Auger is usually disposed in the hopper. The powder conveyed to the hopper by, e.g., a stream of air is introduced into the container via a metering portion positioned at the bottom of the hopper. The metering portion refers to the outlet of the hopper via which toner drops from the hopper into the container. The suction pipe with the air separating portion is movable into and out of th container by being driven by a cylinder or similar drive means. The other end of the suction pipe is communicated to a vacuum pump or similar vacuum source. When the vacuum source is driven, air existing between the particles of the powder is discharged. This implements a toner container capable of being densely and uniformly packed with toner.

While the portion of the suction pipe other than the end portion may be formed of any desired material so long as it is tubular, it is usually formed of stainless steel. The diameter of the suction pipe may be, but not limited to, 4 mm, 5 mm or 8 mm.

Generally, a plurality of containers are positioned on a belt or a turntable and sequentially packed with powder while being conveyed by the belt of the turntable.

At least two filters constituting the end portion of the air separating portion, as stated earlier, may be formed of any suitable material matching with the chemical and physical properties and particle size of the powder used. For example, use may be made of stainless steel, iron or similar metal, paper, cloth, unwoven cloth, or porous ceramics. To prevent air from leaking via a gap between the filters, the filters are connected together by, e.g., Sn—Pb alloy, Al—Zn alloy, Cu—Zn alloy or similar solder, adhesive, or adhesive tape.

Assume that the laminate has three filters by way of example. Then, the laminate has an inner layer implemented by a rough filter having a mesh size of #100 or less, an intermediate layer implemented by a fine filter covering the inner layer and having a mesh size of #2,000 to #3,000, and an outer layer implemented by a rough filer identical with the filter of the inner layer and surrounding the intermediate layer.

To pack the container with powder, the metering portion of the hopper is set in the opening or powder inlet of the container. At the same time, the suction pipe is attached to the top of the container such that the tip of the air separating portion is positioned in the container. While the suction pipe sucks air out of the container, the metering portion of the hopper introduces a metered amount of toner into the container.

The air separating portion implemented by filters has apertures substantially evenly distributed over its entire periphery. This portion can therefore suck air out of the powder over its entire periphery and enhances dense packing of the powder.

Further, the relatively rough filer forming the outer layer of the air separating portion insures sufficient mechanical strength. In addition, powder clogging the filter can be easily removed after the packing operation.

Figure 4:
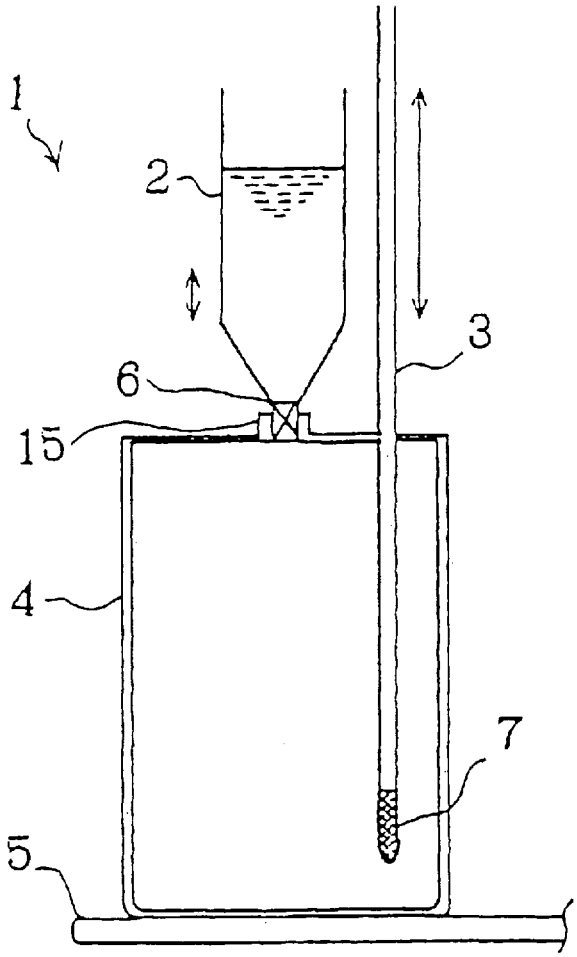
FIG. 4 is a view showing a powder packing apparatus embodying the present invention.

Referring to FIG. 4, a powder packing apparatus embodying the present invention is shown and generally designated by the reference numeral 1. As shown, the apparatus 1 includes a hopper 2 for temporarily storing powder conveyed thereto by, e.g., a stream of air. A suction pipe 3 is communicated to a vacuum pump or similar vacuum source, not shown, at one end thereof. A turntable 5 conveys a container 4 to be packed with the powder. An auger, not shown, is disposed in the hopper 2. A metering portion 6 is formed at the bottom of the hopper 2 for introducing the powder stored in the hopper 2 into the container 4 while metering the powder. The suction pipe 3 has an air separating portion 7 at the other end thereof. A cylinder or similar drive means selectively moves the suction pipe 3 into or out of the container 4. The container 4 is formed with an opening or powder inlet 15 for receiving the powder.

Figure 5:
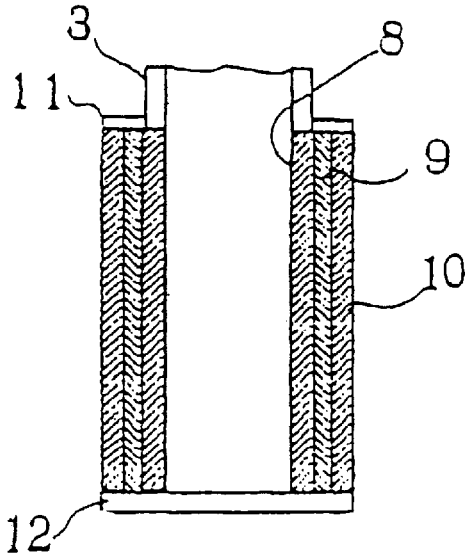
FIG. 5 is a section showing a specific configuration of an air separating portion included in the illustrative embodiment.

As shown in FIG. 5 specifically, the air separating portion 7 includes an inner layer 8, an intermediate layer 8 surrounding the inner layer 8, and an outer layer 10 surrounding the intermediate layer 8. The inner layer 8 is implemented by a filter having a relatively large mesh size of #100 or below. The intermediate layer 8 is implemented by a filter having a relatively small mesh size ranging from #2,000 to #3,000. The outer layer 10, like the inner layer 8, is implemented by a filter having a relatively large mesh size of #100 or below. Connecting portions 11 and 12 connect the three layers 8, 9 and 10 at the top and bottom of the air separating portion 7, respectively.

Figure 6:
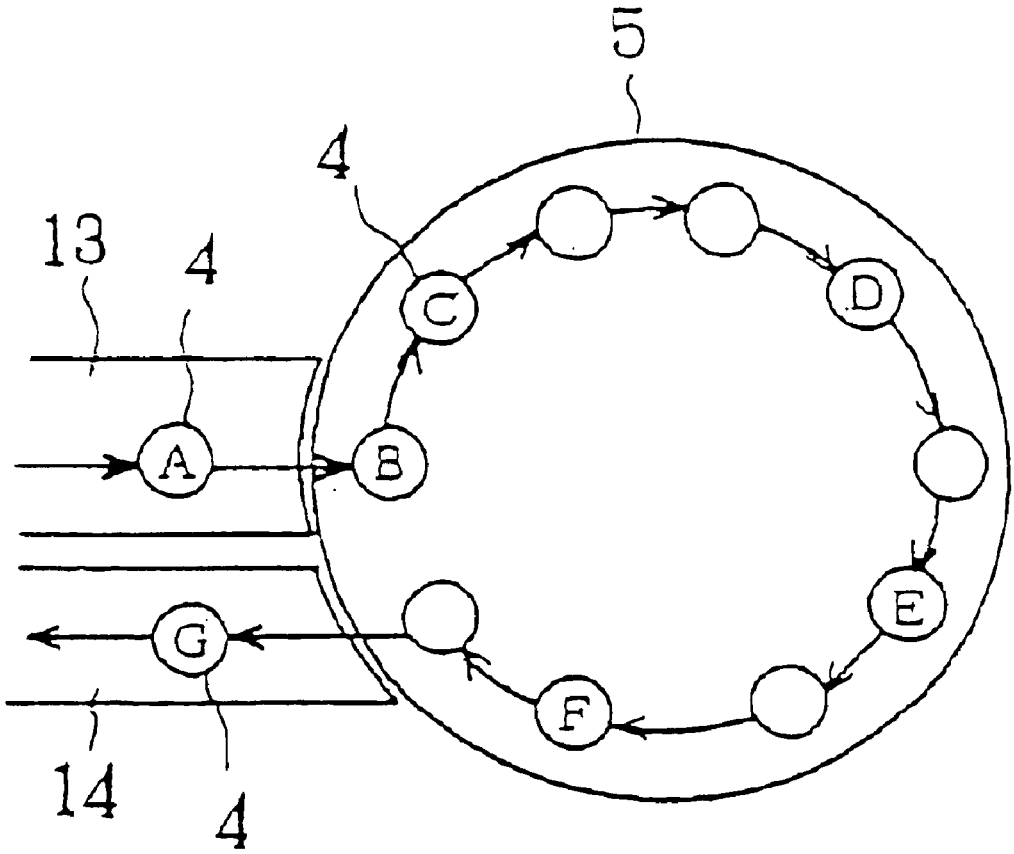
FIG. 6 is a plan view of a turntable also included in the illustrative embodiment.

As shown in FIG. 6, an inlet conveyor 13 and an outlet conveyor 14 are connected to the turntable 5. The container 4 conveyed by the inlet conveyor 13 is transferred from a position A on the conveyor 13 to a position B on the turntable 5. The turntable 5 turns clockwise, as viewed in FIG. 6, and conveys the container 4 from the position B to a position F via positions C, D and E. When the turntable 5 completes substantially one turn, the container 4 is transferred from the turntable 5 to a position G on the outlet conveyor 14. While the turntable 5 so conveys the container 4, the container 4 is packed with the powder fed from the hopper 2.

Figure 7:
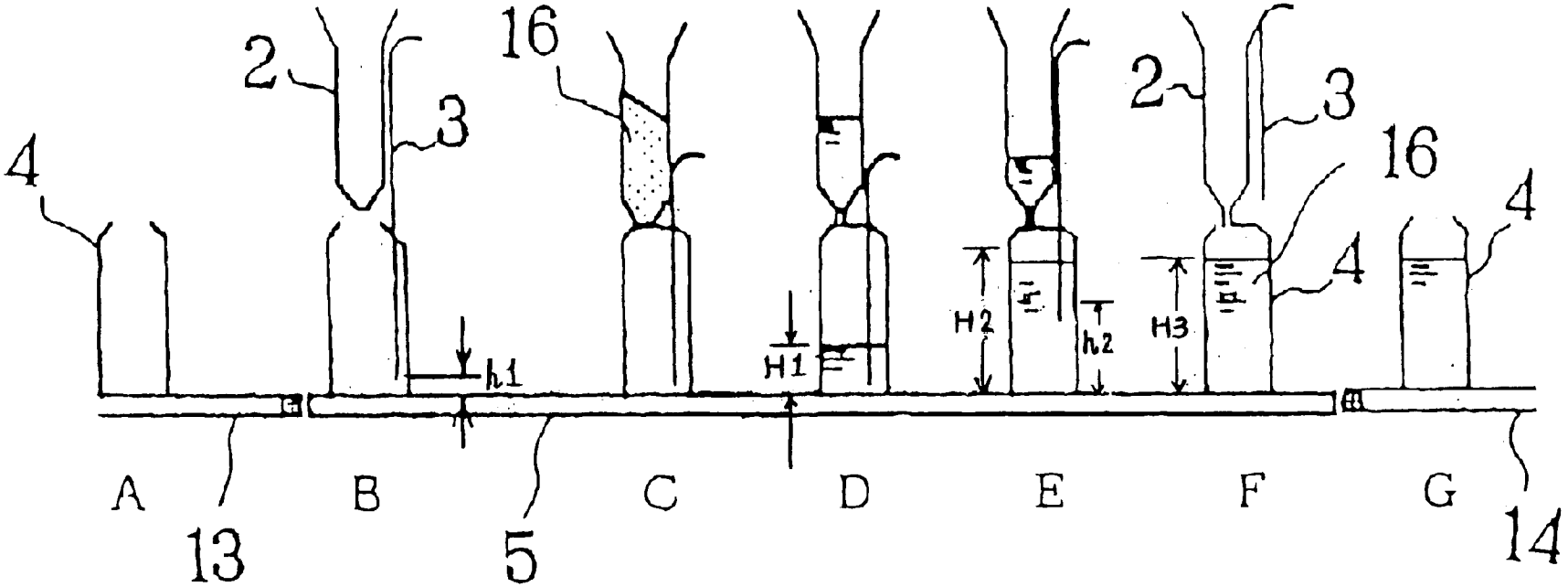
FIG. 7 is a view showing how the illustrative embodiment packs a container with powder at a plurality of consecutive stages.

How the container 4 is packed with the powder will be described more specifically with reference to FIG. 7. As shown, when the container 4 is transferred from the position A on the inlet conveyor 13 to the position B on th turntable 5, the metering portion 6 of the hopp r 2 is set in the opening, FIG. 4, of the container 4. At the same time, the suction pipe 3 is attached to the top of the container 4 such that the tip of the air separating portion 7 is positioned at a height h1 above the bottom of the container 4.

Subsequently, when the container 4, hopper 2 and suction pipe 3 are brought to the position C of the turntable 5, the suction pipe 3 starts sucking air out of the container 4 with vacuum of, e.g., −3 kPa to −60 kPa. At the same time, the metering portion 6 starts transferring the powder, labeled 16, from the hopper 2 to the container 4 while metering it. The container 4 is continuously packed with the powder 16 while it is sequentially moved via the positions C through F of the turntable 5. When the container 4 reaches the position D of the turntable 5, the powder 16 reaches a level H1 in the container 4. The air separating portion 7 separates air from the powder 16 being packed in the container 4 and discharges it.

The air separating portion 7 is a laminate of the inner layer, or sieve net or filter, 8, intermediate layer, or sieve net or filter, 9, and outer layer, or sieve net or filter, 10 each having a particular mesh size, as stated earlier. The air separating portion 7 can therefore suck air existing in the powder 16 over its entire periphery, allowing the container 4 to be densely and accurately packed with the powder 16. In addition, the outer layer 10 having a relatively large mesh size provides the air separating portion 7 with sufficient mechanical strength and durability and thereby promotes easy maintenance.

When the container 4 moved away form the position D of the turntable 5 reaches the position E, the powder 16 being introduced into the container 4 reaches a level H2 above the intermediate level. At this instant, the suction pipe 3 is raised in accordance with the level H2 of the powder 16 and separates air contained in the powder 16. On the arrival of the container 4 at the position E, the air separating portion 7 has its tip raised to an intermediate height h2 in the container 4. In this condition, the air separating portion 7 separates air from the powder 16 existing at the intermediate portion of the container 4.

The packing of the container 4 with the powder 16 and the separation and discharge of air described above are continuously executed until the container 4 reaches the position F of the turntable 5. When the powder 16 in the container 4 reaches a preselected level H3, the metering portion 6 of the hopper 2 is raised away from the opening 15 of the container 7 while the suction pipe 3 is removed from the container 4. The container 4 fully packed with the powder 16 is transferred from the turntable 5 to the outlet conveyor 15.

When the suction pipe 3 is removed from the container 4, air under pressure is fed into the suction pipe 3 and jetted via the air separating portion 7. As a result, the powder left on the air separating portion 7 is removed, i.e., the portion 7 is cleaned.

As stated above, the air separating portion 7 of the suction pipe 3 separates air from the powder 16 introduced into the container 4 and discharges it, allowing the container 4 to be densely packed with the powder 16. Further, the air separating portion 7 is moved in accordance with the level of the powder 16 introduced into the container 4 so as to separate air from the entire powder 16 existing in the container 4. The powder 16 4 can therefore be uniformly and densely packed in the container 16, i.e., in a preselected amount without fail.

Moreover, the suction pipe 3 sucks air out of the contain r 4 during the packing of the container 4, producing vacuum in th container 4. The vacuum promotes rapid drop of the powder 16 from the hopper 2 into the container 4 and thereby increases the packing speed of the powder 16 and packing efficiency.

In illustrative embodiment, the container 4 is continuously packed with the powder 16 while being conveyed by the turntable 5. Alternatively, an arrangement may be made such that when the powder 16 is introduced into the container 4 up to the level H1 at the position D, the packing operation is interrupted so as to cause the air separating portion 7 to separate air from the powder 16 over a preselected period of time. This step will be followed by a step of resuming, on the arrival of the container 4 at the position E, th packing operation up to the level H2, stopping the packing operation, and again causing the air separating portion 7 to separate air from the powder 16 over the preselected period of time. In this manner, the packing of the powder and the suction of air may be intermittently executed a plurality of times. This increases the packing density of the powder 16 for a single packing stage and allows the container 4 to be packed with the powder 16 with uniform density.

Figure 8:
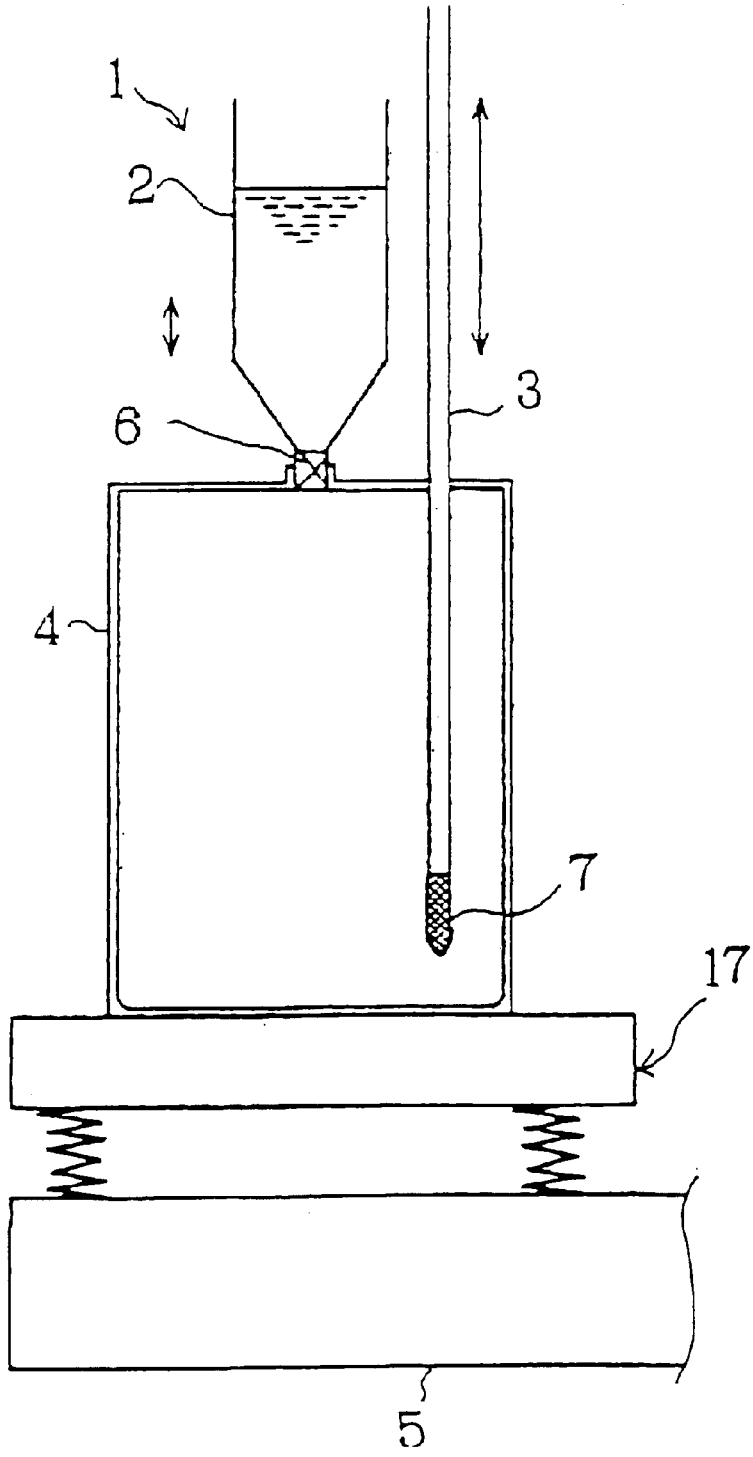
FIG. 8 is a view showing a modification of the illustrative embodiment.

FIG. 8 shows a modification of the illustrative embodiment. As shown, a vibrating device 17 is mounted on the turntable 5. The container 4 is positioned on the vibrating device 17. When the powder 16 is introduced into the container 4, the vibrating device 17 is driven to vibrate the container 4 and powder 16 existing therein. Such vibration further promotes the separation of air from the powder 16.

Figure 9:
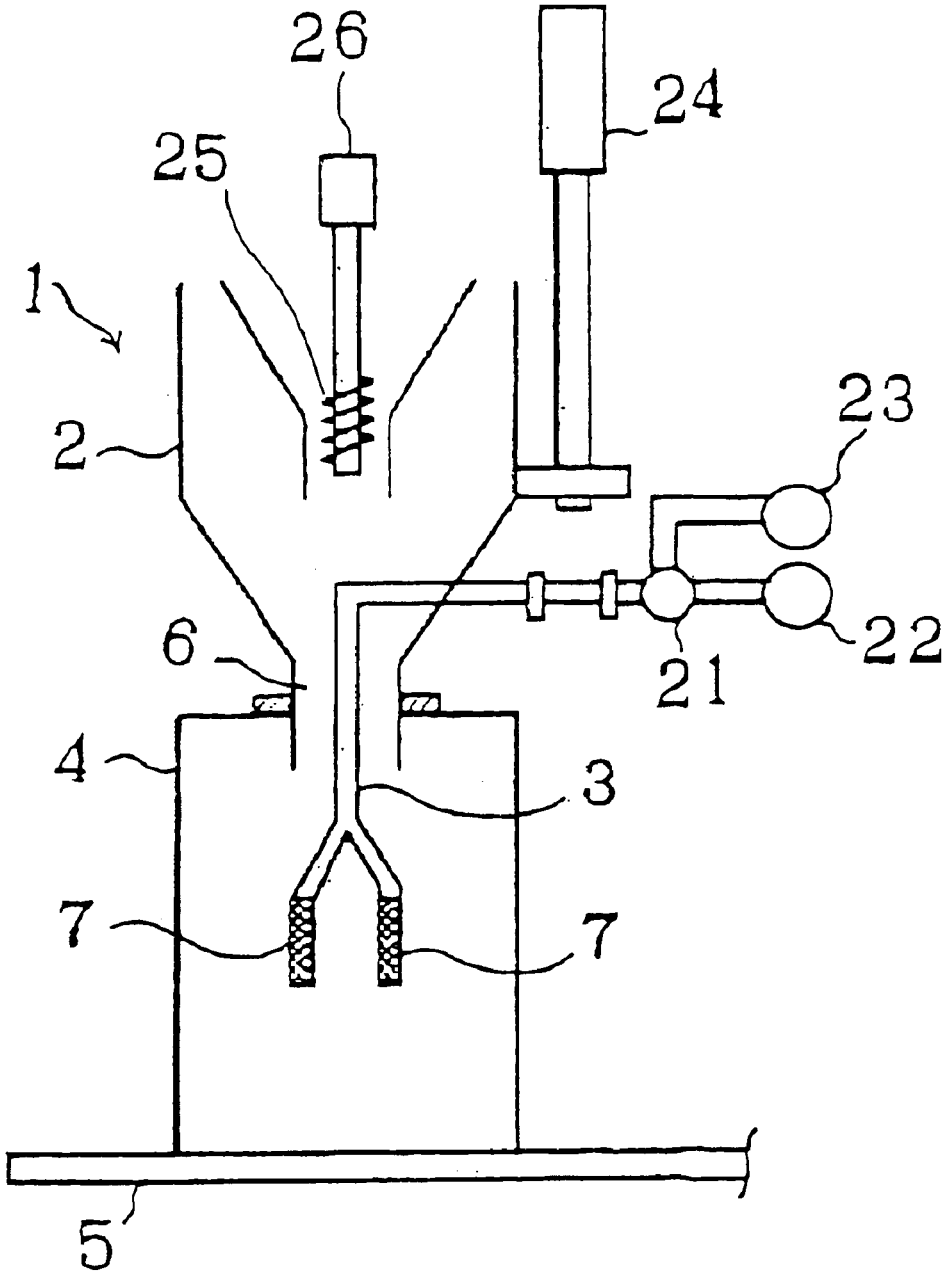
FIG. 9 is a view showing another modification of the illustrative embodiment.

In the illustrative embodiment, the suction pipe 3 is directly attached to the container 4. Alternatively, the suction pipe 3 may be mounted on the hopper 2 or the metering portion 6. FIG. 9 shows a specific arrangement in which the suction pipe 3 is mounted on the metering portion 6 of the hopper 2 and communicated to a vacuum or negative pressure source 22 and a pressure or positive pressure source 23 via a three-way valve 21. The end of the suction pipe 3 is separated into, e.g., two or three branches each having the respective air separating portion 7 at the tip.

In the specific configuration shown in FIG. 9, a cylinder or similar driving device 24 connected to the hopper 2 lowers the hopper 2 in order to set the metering portion 6 in the opening 15 of the container 4. At the same time, the suction pipe 3 is lowered to position the air separating portions 7 in the container 4. Subsequently, vacuum is fed from the vacuum source 22 to the suction pipe 3 so as to suck air out of the container 4. Also, an auger motor 26 is driven to rotate an auger 25 with the result that the powder is transferred from the hopper 2 to the container 4 via the metering portion 6. Air is separated from the powder existing in the container 4 via the plurality of air separating portions 7.

Air is sucked via the plurality of air separating portions 7 and therefore over a broad suction area. This, coupled with the fact that the separation of air is effected at a plurality of levels of the powder, enhances separation efficiency and promotes rapid, dense packing of the container 4.

Assume that the powder being transferred from the hopper 2 to the container 4 includes lumps or that the powder has stopped up the air separating portions 7. Then, the three-way valve 21 is actuated to feed compressed air from the pressure source 23 to the suction pipe 3. Such compressed air is jetted via the air separating portions 7 so as to loosen the lumps or clears the air separating portions 7.

If desired, vacuum used to separate air from the powder 16 may be selectively increased or decreased or may even be intermittently fed.

A specific powder packing method in accordance with the present invention will be described hereinafter. A pipe formed of stainless steel and having a diameter of 5 mm was provided with an air separating portion over 10 cm of its end portion. The air separating portion was made up of the inner layer 8 implemented by a rough filter having a mesh size of #50, intermediate layer 9 implemented by a fine filter having mesh sizes of #500 (horizontal) and 3,500 (vertical), and outer layer 10 identical with the inner layer 8. The three layers 8 through 10 were connected together by Sn—Pb alloy.

The #50 filter was plain fabrics formed of stainless steel SUS316 (trade name) and having a filament diameter of 0.14 mm and an opening of 0.37 mm. The #500 or #3,500 filter was figured cloth formed of stainless steel SUS 316 and having a filament diameter of 0.025 mm and an opening of about 2 $\mu$m to 3 $\mu$m or less.

One end of the suction pipe having the above configuration was connected to an ejector pump or vacuum source (Microejector ME60 available from Koganei). The packing method of the present invention was effected with vacuum of −40 kPa and 500 g of NF Toner (trade name; nonmagnetic two-ingredient toner having true specific gravity of about 1.2) available from Ricoh Co. Ltd. The method was found to density pack a container with bulk density of 0.5 g/cc in only 7 seconds. By contrast, the packing apparatus taught in Laid-Open Publication No. 7-125702 stated earlier implemented bulk density of only 0.3 g/cc in 15 seconds as to NF Toner.

In summary, a method of packing a container with powder and an apparatus therefor of the present invention have various unprecedented advantages, as enumerated below.

(1) A suction pipe includes an air separating portion formed by a plurality of layers implemented by sieve nets or filters each having a particular mesh size. The air separating portion can therefore suck air contained in powder over its entire periphery, realizing dense, accurate packing.

(2) The sieve net or filter constituting the outer layer has a relatively large mesh size and provides the air separating portion with sufficient mechanical strength. This successfully enhances the durability of the air separating portion and promotes efficient maintenance.

(3) The container is packed with powder at a plurality of consecutive stages while air is separated and discharged over a preselected period of time at each stage. This increases packing density for a single stage and allows the container to be uniformly and densely packed with the powder.

(4) At the time of packing, the container is caused to vibrate in order to separate air from the powder more efficiently.

(5) The end of the suction pipe is separated into a plurality of branches each having the respective air separating portion. Air is sucked via the plurality of air separating portions and therefore over a broad suction area. This, coupled with the fact that the separation of air is effected at a plurality of levels of the powder, enhances separation efficiency and promotes rapid, dense packing of the container.

(6) After the packing of the container, air under pressure is fed to the suction pipe and ejected via the air separating portions. The suction pipe can therefore be easily cleaned and allows the packing operation to be stably repeated.

Various modifications will become possible for those skilled in the art after receiving the teachings of the present disclosure without departing from the scope thereof.

What is claimed is:

1. A method of packing a container including a powder inlet and an air outlet with powder, said method comprising the steps of:

(A) connecting a powder outlet of a hopper capable of storing the powder to the powder inlet, attaching a suction pipe to the air outlet, and then introducing said powder stored in said hopper into the container; and (B) discharging air existing between particles of the powder introduced into the container via said suction pipe to which vacuum is fed;

wherein an end portion of said suction pipe to be positioned at least in the container after attachment to said container and constituting an air separating portion comprises at least one tubular filter extending from the end portion of said suction pipe such that said end portion of said suction pipe does not extend inside of said tubular filter, and wherein each of said at least one tubular filter includes an intermediate layer sandwiched between inner and outer layers, the inner and outer layers have relatively large mesh size compared with the intermediate layer, and each of the inner layer, the intermediate layer and the outer layer is cylindrical.

2. The method as recited in claim 1, wherein the at least one tubular filter comprises a laminate of three filters.

3. The method as recited in claim 2, wherein the laminate of three tubular filters includes an intermediate layer sandwiched between inner and outer layers.

4. The method as recited in claim 3, wherein the inner and outer layers have relatively large mesh size compared with the intermediate layer.

5. An apparatus for packing a container including a powder inlet and an air outlet with powder, said apparatus comprising:

a hopper connectable to the powder inlet and capable of storing the powder; and a suction pipe attachable to the air outlet;

wherein an end portion of said suction pipe to be positioned at least in the container after attachment to said container and constituting an air separating portion comprises at least one tubular filter extending from the end portion of said suction pipe such that said end portion of said suction pipe does not extend inside of said tubular filter, and wherein each of said at least one tubular filter includes an intermediate layer sandwiched between inner and outer layers, the inner and outer layers have relatively large mesh size compared with the intermediate layer, and each of the inner layer, the intermediate layer and the outer layer is cylindrical.

6. The apparatus as recited in claim 1, wherein the at least one tubular filter comprises a laminate of three filters.

7. The apparatus as recited in claim 6, wherein the laminate of three tubular filters includes an intermediate layer sandwiched between inner and outer layers.

8. The apparatus as recited in claim 7, wherein the inner and outer layers have relatively large mesh size compared with the intermediate layer.

9. A pipe for separating and discharging air existing between particles of powder packed in a container, at least an end portion of said pipe comprises at least one tubular filter extending from the end portion of said pipe such that said end portion of said pipe does not extend inside of said tubular filter, wherein each of said at least one tubular filter includes an intermediate layer sandwiched between inner and outer layers, the inner and outer layers have relatively large mesh size compared with the intermediate layer, and each of the inner layer, the intermediate layer and the outer layer is cylindrical.

10. The pipe as recited in claim 9, wherein the at least one tubular filter comprises a laminate of three filters.

11. The pipe as recited in claim, 10, wherein the laminate of three tubular filters includes an intermediate layer sandwiched between inner and outer layers.

12. The pipe as recited in claim 11, wherein the inner and outer layers have relatively large mesh size compared with the intermediate layer.

* * * * *